United States Patent [19]

Sealey et al.

[11] 4,230,352

[45] Oct. 28, 1980

[54] DECOMPRESSION RELEASE DOOR LATCH AND STOP

[75] Inventors: Francis Sealey, Bellevue; Stephen T. Steadman, Redmond, both of Wash.

[73] Assignee: Boeing Commercial Airplane Company, Seattle, Wash.

[21] Appl. No.: 26,102

[22] Filed: Apr. 2, 1979

[51] Int. Cl.[3] ..... E05B 15/00; E05C 19/02

[52] U.S. Cl. ..... 292/341.17; 292/18; 292/78; 292/DIG. 65

[58] Field of Search ..... 292/341.17, 341.15, 292/341.16, 18, 21, 78, 79, 92, DIG. 65; 47/364

[56] References Cited

U.S. PATENT DOCUMENTS

| | | | |
|---|---|---|---|
| 2,016,519 | 10/1935 | Schmidt | 292/341.17 X |
| 2,741,505 | 4/1956 | Courney | 292/341.17 |
| 2,777,315 | 1/1957 | Burke | 292/341.17 X |
| 2,848,263 | 8/1958 | Miller | 292/78 |

FOREIGN PATENT DOCUMENTS

| | | | |
|---|---|---|---|
| 795037 | 5/1958 | United Kingdom | 292/18 |
| 942906 | 11/1963 | United Kingdom | 292/78 |

*Primary Examiner*—William E. Lyddane

*Attorney, Agent, or Firm*—Morris A. Case; Bernard A. Donahue

[57] ABSTRACT

A pivotably mounted door stop linkage has a resilient member acting on the linkage to maintain the door stop in position for conventional door operation while allowing rotation of the stop to release the door in reaction to a pressure differential acting across the door.

13 Claims, 7 Drawing Figures

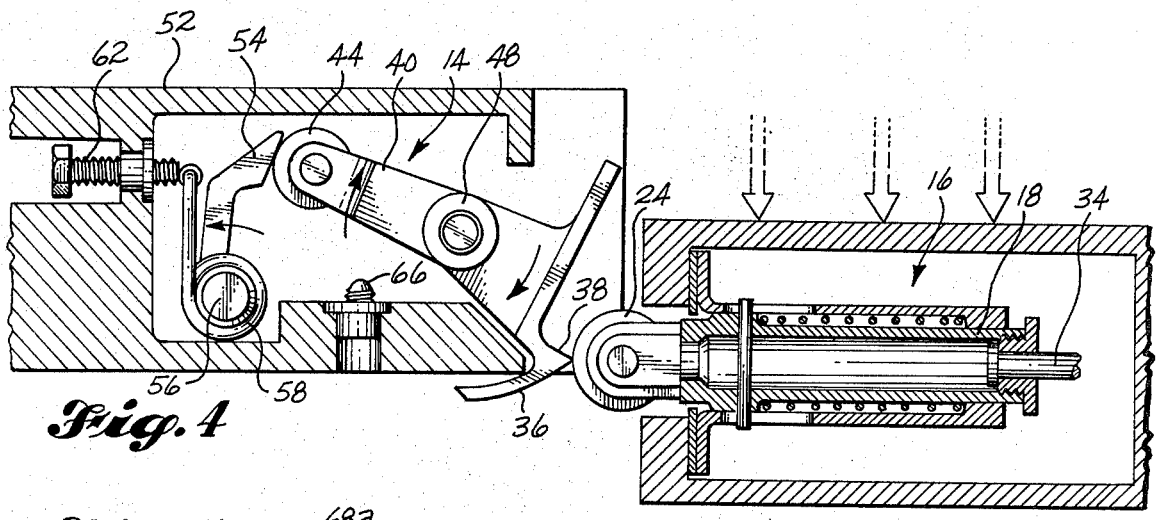
Fig. 4
Fig. 5
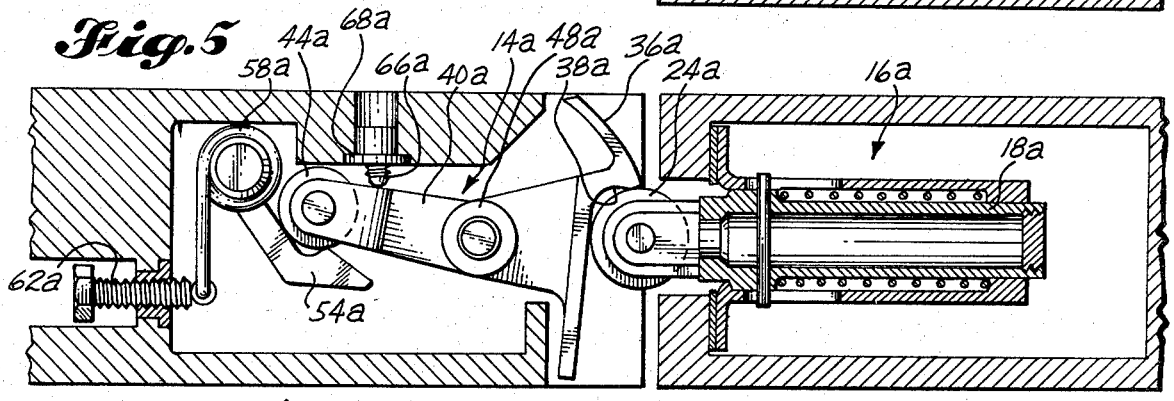
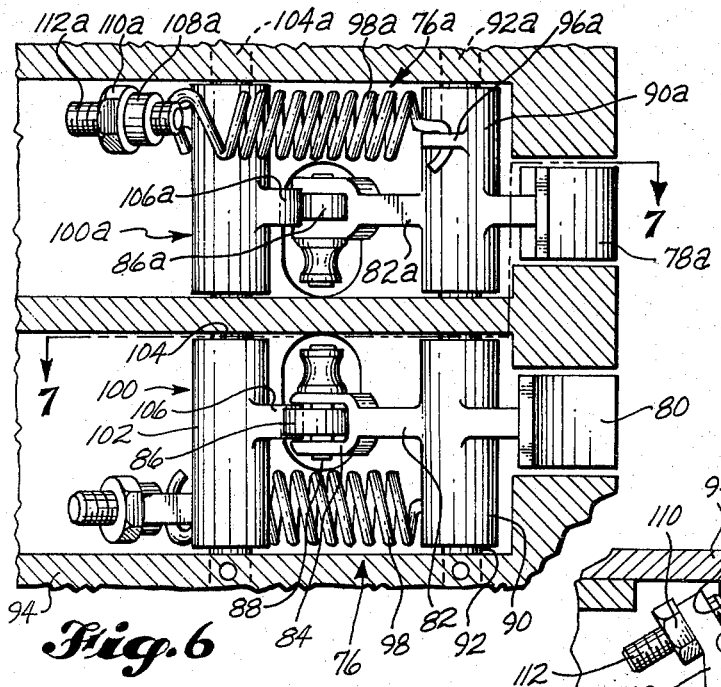
Fig. 6
Fig. 7
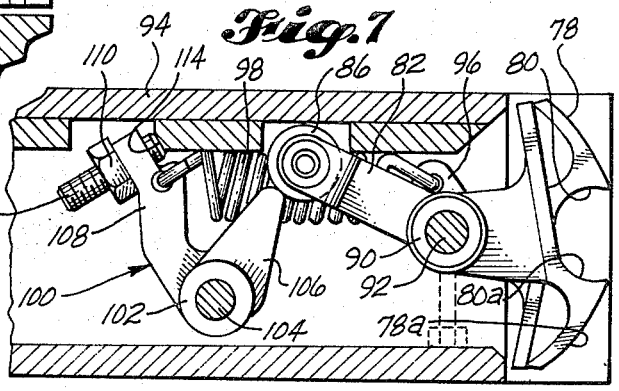

DECOMPRESSION RELEASE DOOR LATCH AND STOP

BACKGROUND OF THE INVENTION

There are many cases where it is desirable that access areas such as doors and/or windows have provisions to automatically open in response to rapid pressurization or rapid decompression to allow the access area to be opened and prevent structural damage elsewhere due to the rapid pressure change. U.S. Pat. Nos. 1,887,484 and 2,621,377 show pressure relief mechanisms for windows, and U.S. Pat. No. 3,571,977 showed a pressure release mechanism for an access door. It was found that pressure relief can be provided for a door that will permit the door to automatically open in response to sudden pressure change on either side of the door.

SUMMARY OF THE INVENTION

A pivotable linkage is used as a door stop. One end of the linkage has the stop, the other end has a cam and the linkage is pivotably mounted in an intermediate location. A pivotable cam arm acts against the cam and is resiliently held to prevent linkage rotation under normal conditions, but to allow the linkage to rotate and release the door latch in response to a pressure differential acting across the door.

It is an object of this invention to provide a door that will automatically open in response to a pressure differential.

It is another object of this invention to provide a door that will automatically open in response to a pressure differential acting on either side of the door.

It is another object to provide a mechanism that will automatically reset itself after allowing automatic opening of a door in response to pressure change.

DESCRIPTION OF THE DRAWINGS

FIG. 4 is a view as in FIG. 2 with the door stop actuated in response to a pressure differential to automatically open the door.

FIG. 5 is a side elevational sectional view taken along line 5—5 of FIG. 1.

FIG. 6 shows a plan view of a different embodiment of this invention with the door stop part only shown.

FIG. 7 shows a side elevational view taken along line 7—7 of FIG. 6.

DETAILED DESCRIPTION

Figure 1:
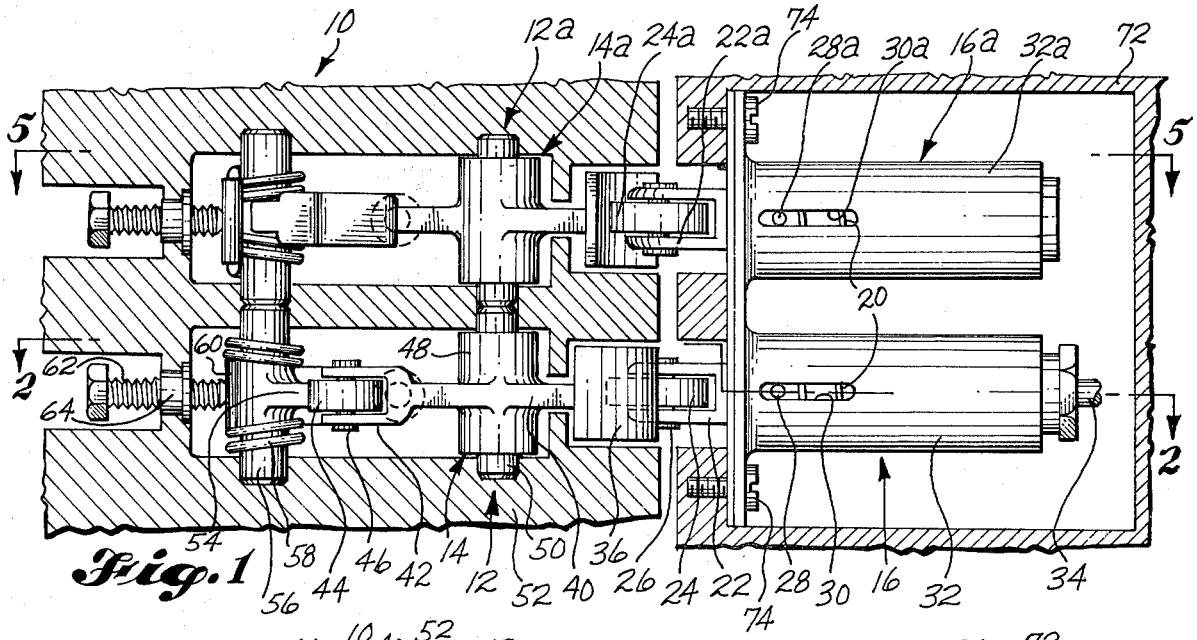
FIG. 1 shows a plan view of door latches and stops of this invention to provide pressure release for either side of the door.
Figure 2:
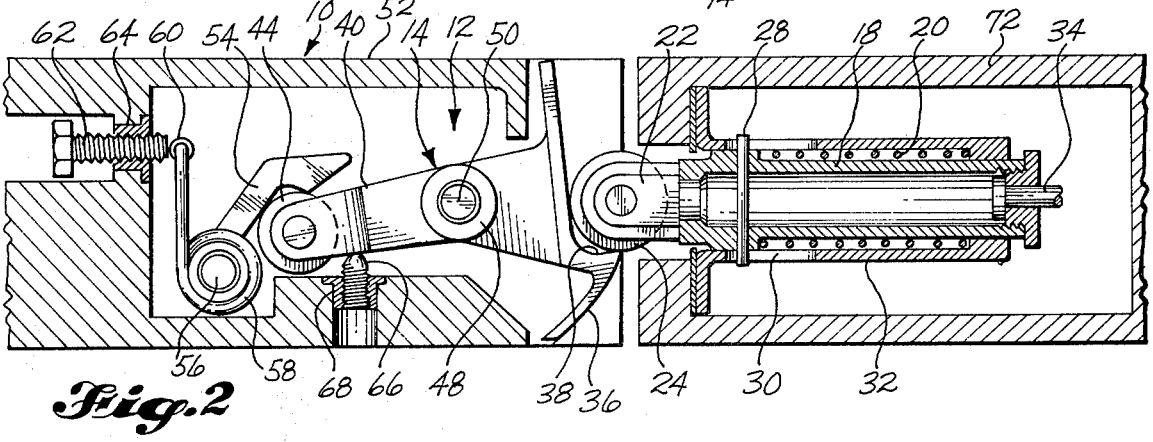
FIG. 2 is a side elevational sectional view taken along lines 2—2 of FIG. 1.
Figure 3:
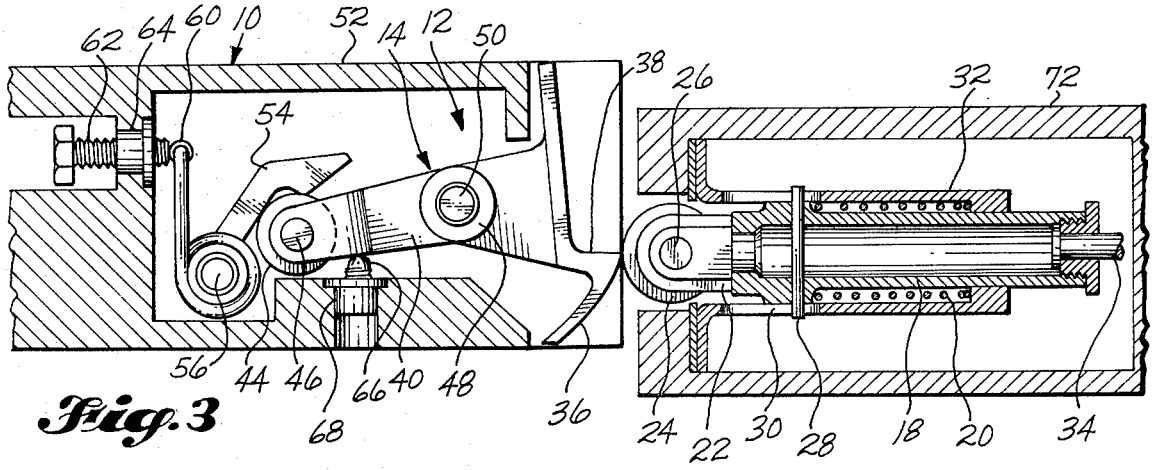
FIG. 3 is the view as in FIG. 2 with the door latch actuated to permit opening the door.

A door latch and stop mechanism 10 has a first mechanism 12 made up of a stop mechanism 14 and a latch mechanism 16, and a second mechanism 12*a* made up of a stop mechanism 14*a* and a latch mechanism 16*a*. The two mechanisms are identical, however they are diametrically aligned. Identical parts will be given the same number, however, if the part is diametrically aligned it will be given the same number modified by use of a letter.

The door latch has a pluger 18 resiliently urged to the closed position with spring 20, and on the open end the plunger has an integral yoke 22 to which a roller 24 is attached with a bearing pin 26 to permit free rotation of the roller. Radial alignment of the plunger is controlled with pin 28 which operates in opening 30 of the housing 32 for the latch. The plunger is actuated for normal door operation through movement on the latching rod 34 by use of a door handle, not shown.

The stop mechanism 14 has a striker plate 36 with a latch stop surface 38 which is located on one end of a linkage 40. On the other end of the linkage there is a yoke 42 with a cam roller 44 mounted to the yoke with bolt 46 to enable the roller to freely rotate. Intermediate the ends of the linkage is a hub 48 through which shaft 50 extends. The shaft is mounted to latch housing 52 to permit the linkage to rotate. Cam arm 54 is pivotably mounted to the latch housing with a shaft 56. A torsion spring 58 is mounted on the cam arm, and the spring resiliently acts to continuously press the cam arm against the cam 44 on the linkage 40. The reaction point 60 of the spring is acted on by bolt 62 located in bushing 64 to adjustably set the pressure from the spring. The cam arm rotates the linkage until it contacts an adjusting screw 66 which is mounted in a bushing 68 and located to limit the rotation of the linkage. By adjusting the screw the linkage is set for controlling the stop surface 38 location for normal door operation. The cam arm contacts the cam along a line 70 toward the pivot point with respect to the axis of the cam when the linkage is held against the adjusting screw.

For operation the door latches 16 and 16*a* are mounted to door structure 72 with mounting bolts 74. The adjusting screws 66 and 66*a* are adjusted to place the door stop surfaces 38 and 38*a* so that the door latch rollers 24 and 24*a* press against the stop surfaces and hold the door in the closed position. To open the door the latching rod 34 is actuated to move the plunger 18 with latch roller 24 away from the stop to permit the door to open. In this embodiment latch mechanism 16*a* does not use a latch rod, such as latch rod 34 used in latch mechanism 16, as in normal door operation the door always opens in one direction. However, it is not intended to limit to a one direction door operation as a latch rod may be used in latch mechanism 16*a* to permit normal door operation to open in either direction. Should a rapid pressure change be exerted on either side of the door, the latch roller will exert sufficient pressure against the stop surface to overcome the torsion spring and the linkage rotates to free the latch and permit the door to open. FIG. 4 shows the door being opened in response to a pressure differential acting across the door.

FIGS. 6 and 7 show yet another embodiment of a latch stop mechanism to permit door opening in either direction in response to a pressure differential acting on the door. In this embodiment there is a latch stop mechanism 76, and a diametrically aligned latch stop mechanism 76*a*. Mechanism 76 has a striker plate 78 and a latch stop surface 80 located on one end of a linkage 82. On the other end of the linkage there is a yoke 84 with a cam roller 86 mounted to the yoke with bolt 88. Intermediate the ends of the linkage there is a hub 90 having a shaft 92 for mounting to latch housing 94 to permit the linkage to pivot. The hub has a projection 96 to which an end of a tension spring is mounted. The latch stop mechanism 76 has a second linkage 100, which has a hub 102 pivotably mounted to the latch housing 94 with a shaft 104, an arm 106 extending to contact and act as a cam follower to linkage cam roller 86, and a second arm 108 to which the other end of the tension spring 98 is attached. Mounted near the end of the second arm is a bushing 110 with an adjusting screw 112, which bears against surface 114 of the door jamb structure 94 to permit adjustment of the door latch stop release load. The tension spring in combination with the two linkages holds the stop in position for normal door operation, allows the stop to be swung to release the door in response to a pressure differential acting across the door, and automatically resets itself. The diametrically aligned latch stop mechanism 76*a* permits the door to be released in response to a pressure differential acting across the other side of the door. It is understood that if door pressure release is required in only one direction that a single door latch and door latch stop mechanism will be used.

We claim:

1. A pressure responsive release door latch and latch stop mechanism mounted in a door member and a door jamb member, with the mechanisms comprising: a door latch mounted to one of the members; a linkage having a door latch stop at one end, a cam with roller at the other end and intermediate pivotable mounting to the other member; a pivotably mounted rocker arm located to contact the side of the cam roller; and resilient means for acting on the cam through the rocker arm to hold the door stop in position for normal operation and to permit rotation of the linkage to release the latch in response to a pressure differential acting across the door.

2. A pressure responsive release door latch and latch stop as in claim 1 further comprising a matching latch and latch stop mechanism diametrically aligned to permit linkage rotation and stop movement in response to a pressure differential acting across the other side of the door.

3. A pressure responsive release door latch and latch stop as in claim 1 wherein the resilient means includes a torsion spring.

4. A pressure responsive release door latch and latch stop as in claim 3 further comprising an adjustable means acting on the linkage for controlling stop location for normal door operation.

5. A pressure responsive release door latch and latch stop as in claim 3 further comprising a matching latch and latch stop mechanism diametrically aligned to permit linkage rotation and stop movement in response to a pressure differential acting across the other side of the door.

6. A pressure responsive release door latch and latch stop as in claim 1 wherein the resilient means includes a tension spring that provides an automatic reset of the pressure released latch stop mechanism.

7. A decompression release door latch and latch stop as in claim 6 further comprising an adjustable means acting on the rocker arm for adjusting door stop release load.

8. A pressure responsive release door latch and latch stop as in claim 6 further comprising a matching latch and latch stop mechanism diametrically aligned to permit linkage rotation and stop movement in response to a pressure differential acting across the other side of the door.

9. A latch mechanism and a latch stop mechanism mounted to coact for pressure responsive release of a door member for a door jamb member, with the mechanism comprising: a door latch mounted to one of the members, a linkage pivotally mounted intermediately to the other member and having one end as a stop for the latch and the other end as a cam with roller, and a cam rocker arm pivotally mounted to contact a side of the cam roller has a spring forceably holding the cam rocker arm in contact with the cam to hold the latch stop in position for normal door actuation while allowing the stop to move to release the latch in response to a pressure differential across the door.

10. A latch mechanism and a latch stop mechanism as in claim 9 wherein the spring is a torsion spring.

11. A latch mechanism and a latch stop mechanism as in claim 9 wherein the spring is a tension spring.

12. A latch mechanism and a latch stop mechanism as in claim 9 further comprising an adjustable means acting on the linkage for controlling stop location for normal door location.

13. A latch mechanism and a latch stop mechanism in claim 12 further comprising a matching latch and stop mechanism diametrically aligned to permit linkage rotation and stop movement in response to a pressure differential acting on the other side of the door.

* * * * *